US008209906B2

(12) United States Patent
Romich

(10) Patent No.: US 8,209,906 B2
(45) Date of Patent: Jul. 3, 2012

(54) NOISE DAMPENER FOR A GARAGE DOOR OPENER

(76) Inventor: Frederick John Romich, Calgary (CA)

( * ) Notice: Subject to any disclaimer, the term of this patent is extended or adjusted under 35 U.S.C. 154(b) by 954 days.

(21) Appl. No.: 11/448,891

(22) Filed: Jun. 8, 2006

(65) Prior Publication Data

US 2007/0283627 A1 Dec. 13, 2007

(51) Int. Cl.
*E05F 11/00* (2006.01)

(52) U.S. Cl. ..... 49/199; 267/141.11; 267/141; 267/153

(58) Field of Classification Search ..... 267/140.11, 267/141, 153; 49/197, 199
See application file for complete search history.

(56) References Cited

U.S. PATENT DOCUMENTS

| | | | | |
|---|---|---|---|---|
| 2,831,673 | A * | 4/1958 | Paulsen | 267/153 |
| 4,379,480 | A | 4/1983 | Kempel et al. | |
| 4,415,391 | A * | 11/1983 | Reid | 156/187 |
| 5,032,342 | A * | 7/1991 | Drabing et al. | 264/263 |
| 5,082,252 | A * | 1/1992 | Miyamoto | 267/140.13 |
| 5,280,890 | A * | 1/1994 | Wydra | 267/220 |
| 5,704,341 | A * | 1/1998 | Ritzenthaler | 124/8 |
| 5,761,850 | A | 6/1998 | Lhotak et al. | |
| 5,787,677 | A | 8/1998 | Bolich et al. | |
| 5,829,732 | A * | 11/1998 | Yamaguchi et al. | 248/610 |
| 6,178,705 | B1 | 1/2001 | Lefebvre | |
| 6,185,783 | B1 | 2/2001 | Carpinella | |
| 6,264,164 | B1 * | 7/2001 | Steinmaier | 248/610 |
| 6,343,777 | B1 * | 2/2002 | Andra | 248/610 |
| 6,402,119 | B1 * | 6/2002 | Miska | 248/613 |
| 6,464,053 | B1 * | 10/2002 | Hoebrechts | 188/322.15 |
| 6,709,618 | B2 * | 3/2004 | Makino et al. | 264/250 |
| 6,729,380 | B2 | 5/2004 | Whitley et al. | |
| 6,847,136 | B2 | 1/2005 | Mattson | |
| 6,851,506 | B2 * | 2/2005 | Bovio | 180/296 |
| 7,575,216 | B2 * | 8/2009 | Zimmermann et al. | 248/610 |
| 2001/0020667 | A1 * | 9/2001 | Garaud et al. | 248/60 |
| 2003/0197317 | A1 | 10/2003 | Meisel et al. | |
| 2005/0011126 | A1 | 1/2005 | Mattson et al. | |
| 2005/0194728 | A1 * | 9/2005 | Molet et al. | 267/151 |
| 2005/0200063 | A1 * | 9/2005 | Molet et al. | 267/153 |

FOREIGN PATENT DOCUMENTS

| | | | |
|---|---|---|---|
| JP | 05118366 A | * | 5/1993 |
| JP | 05164166 A | * | 6/1993 |
| JP | 05164167 A | * | 6/1993 |
| JP | 05223137 A | * | 8/1993 |

* cited by examiner

*Primary Examiner* — Jerry Redman
(74) *Attorney, Agent, or Firm* — Anthony R. Lambert

(57) ABSTRACT

A noise dampener for a garage door opener includes a pair of resilient members, each resilient member of the pair of resilient members having first and second opposite ends. The first ends are adapted for mounting to a garage ceiling mounting bracket. The second ends are adapted for mounting to motor mounts mounted to an upper side of a motor housing of the garage door opener. The first and second ends of the resilient members are mountable to the ceiling mounting bracket and the motor mounts respectively by fastening means through apertures in the first and second ends. A vibration dampening pad is provided for mounting between the garage wall adjacent the garage door and a chain channel support extending from the motor housing.

17 Claims, 8 Drawing Sheets

Fig. 1 - Prior Art

NOISE DAMPENER FOR A GARAGE DOOR OPENER

FIELD OF THE INVENTION

This invention relates to the field of garage door openers, and in particular to noise dampening systems for garage door openers.

BACKGROUND OF THE INVENTION

Garage door openers are characteristically comprised of two primary components, namely a motor and a chain. The motor is mounted in a housing. The housing is suspended from the garage ceiling, set back from the garage door. Typically a long piece of metal channel extends from the housing to the garage wall above the door. The chain runs in or on the channel. The distal end of the channel is rigidly affixed to the wall above the garage door. Ordinarily the chain is a heavy gauge endless or circular chain. An arm extends from the chain to the top of the garage door. The chain turns around, and is driven by, a drive sprocket extending from the motor. The chain also turns around an idler sprocket or the like at the opposite end of the channel adjacent the wall above the garage door.

When engaged, the motor turns the drive sprocket. The drive sprocket turns the chain thereby causing the arm and, consequently, the garage door to move either toward or away from the motor. The motor is attached to the garage ceiling by means of two or more metal bars or struts, the upper ends of which are ordinarily rigidly mounted to the wood trusses above the ceiling.

As garage doors are heavy, the garage door opener motor must be sufficiently powerful in order for it to lift the door by pulling the arm along the channel. The supports attaching the motor housing to the ceiling must be sufficiently strong to bear the static weight of the motor as well as the additional strain created when the motor is running and the chain and garage door are in motion.

When operating, the running of the motor, and in particular, the action of the sprocket and chain, create significant vibration. This vibration is evidenced by significant noise in the garage and by the generation of acoustic frequency vibration transmitted to the structure of the building via the struts which are rigidly attached to the ceiling and thus through to the ceiling joists above. The vibration is also transmitted through the end of the channel where it is rigidly mounted to the wall above the garage door. The struts and chain channel, being both rigid, are good conduits of the acoustic frequency vibration. The vibration generated by the motor and chain operation is transmitted through the struts, and to a lesser degree through the chain channel, into the structure of the building resulting in noise being heard inside the building. Although Applicant does not wish to be bound by any particular theory of operation, it is postulated that the acoustic frequency vibration created by the motor and chain is transmitted into the structural framework of the building. Thus, being of a dense mass, the framework effectively transmits the acoustic frequency vibration to other parts of the building. In addition, the space between the walls of the building each covered, for example, by drywall, may act to amplify the sound. In the case in many multi-unit buildings where the framework of the building is concrete or steel, the structure makes an excellent transmitter of sound.

Hence, there is a need for, and it is one object of the present invention to provide a means to attenuate the structure-borne acoustic vibration created by the operation of a conventional garage door opener.

SUMMARY OF THE INVENTION

The invention described here is for use with a garage door motor as is found in conventional garage door openers, wherein a motor-driven chain functions to raise and lower the garage door.

The present invention replaces, in whole or in part, the conventional use of rigid metal struts attaching the motor to the ceiling and building frame. The struts are replaced in whole or in part with resilient hangers comprised of a resilient material such as rubber. To mount the motor to the ceiling, one end of each of the resilient hangers is attached to the motor housing or struts. The other ends of the resilient hangers are attached to a rigid mounting bar. The mounting bar is rigidly mounted to the garage, advantageously so as to perpendicular the direction of the garage trusses. Orienting the mounting bar across the trusses makes it easier to mount the mounting bar to both the garage ceiling and the garage trusses. This is because the mounting bar may be provided with holes along its length, and the installer may thus simply use whichever holes in the mounting bar align with the garage trusses so as to bolt the mounting bar directly into the bottom of the trusses. Quite often this orientation of the mounting bar means that the motor must be mounted perpendicular to the mounting bar. This orientation is also advantageous in that the position of the motor may be easily adjusted along the mounting bar so as to align with the center of the garage door even though the motor does not align directly under one or more of the trusses.

The use of at least two resilient hangers, one on each side of the motor housing, equalizes the distribution to the mounting bar of the weight of the motor, housing, channel, chain, etc. and helps maintain the motor level. The ability to retrofit the resilient hangers to a variety of makes and models of conventional garage door openers adds utility to the present invention.

In summary, the noise dampener for a garage door opener of the present invention may be characterized in one aspect as including a pair of resilient members, each resilient member of the pair of resilient members having first and second opposite ends. The first ends are adapted for mounting to a garage ceiling mounting bracket. The second ends are adapted for mounting to motor mounts mounted to an upper side of a motor housing of the garage door opener. The first and second ends of the resilient members are mountable to the ceiling mounting bracket and the motor mounts respectively by fastening means through apertures in the first and second ends. A vibration dampening pad is provided for mounting between the garage wall adjacent the garage door and a chain channel support extending from the motor housing.

The first and second ends are wide so as to provide a widened bearing surface for distributing the weight load from the garage door opener to the ceiling. The second ends are widened so as to distribute the weight load when the second ends are mounted to the motor mounts.

In one embodiment the pair of resilient elongate members are each substantially rectangular so as to provide the bearing surfaces on each of the first and second ends, the first and second ends have a plurality of apertures therein for journaling fasteners therethrough.

A centre portion of each elongate member may include an elongate aperture so that the centre portion comprises a substantially parallel spaced apart array of elongate resilient struts extending between the first and second ends.

DETAILED DESCRIPTION OF EMBODIMENTS OF THE INVENTION

Figure 1:
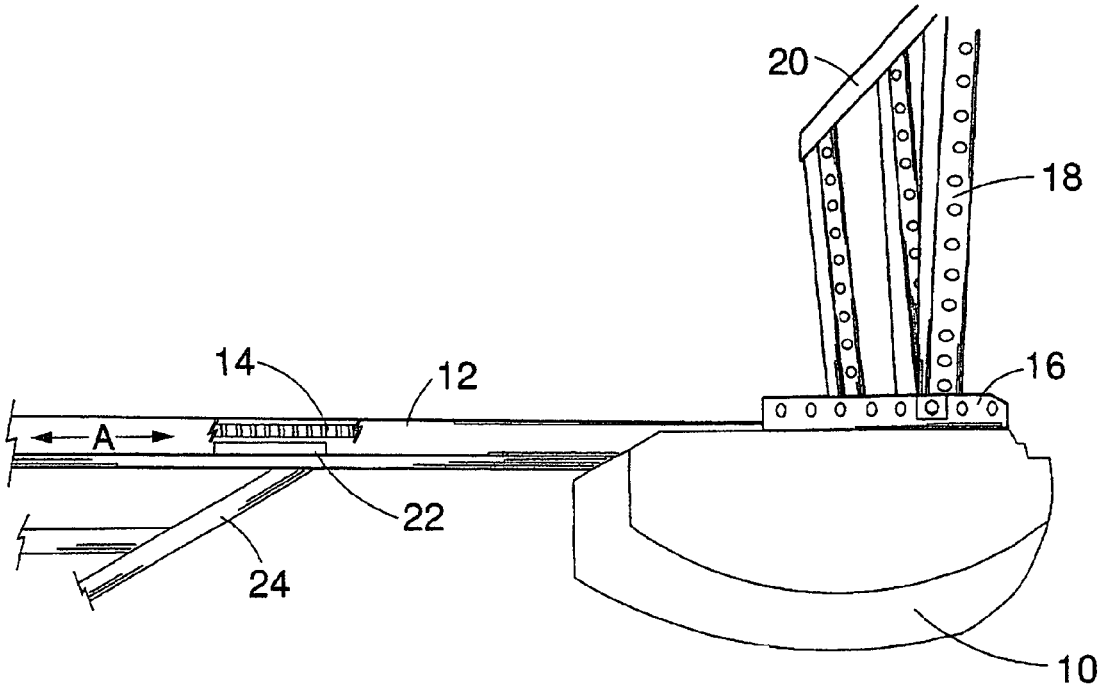
FIG. 1 is, in right side perspective view, a conventional garage door opener.

FIG. 1 depicts a conventional garage door opener motor housing 10, chain channel 12, chain 14, motor housing mounting rails 16, metal struts 18 and ceiling mounting bar 20. Chain 14 is an endless chain which slides carriage 22 in direction A along channel 12 thereby drawing the garage door along by means of connecting arm 24.

Figure 2:
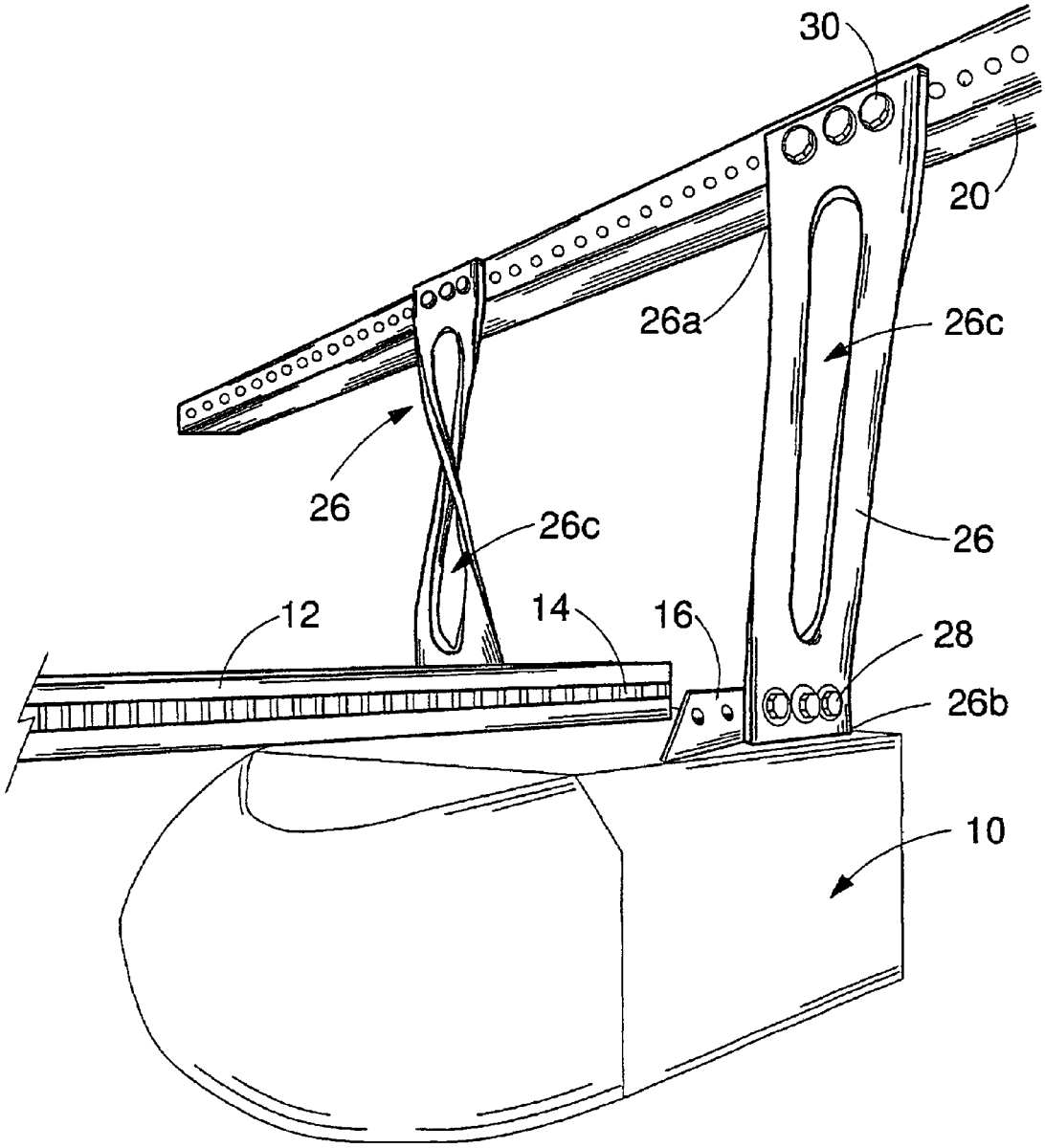
FIG. 2 is, in right side perspective view, one embodiment of the noise dampener for a garage door opener according to the present invention.
Figure 3:
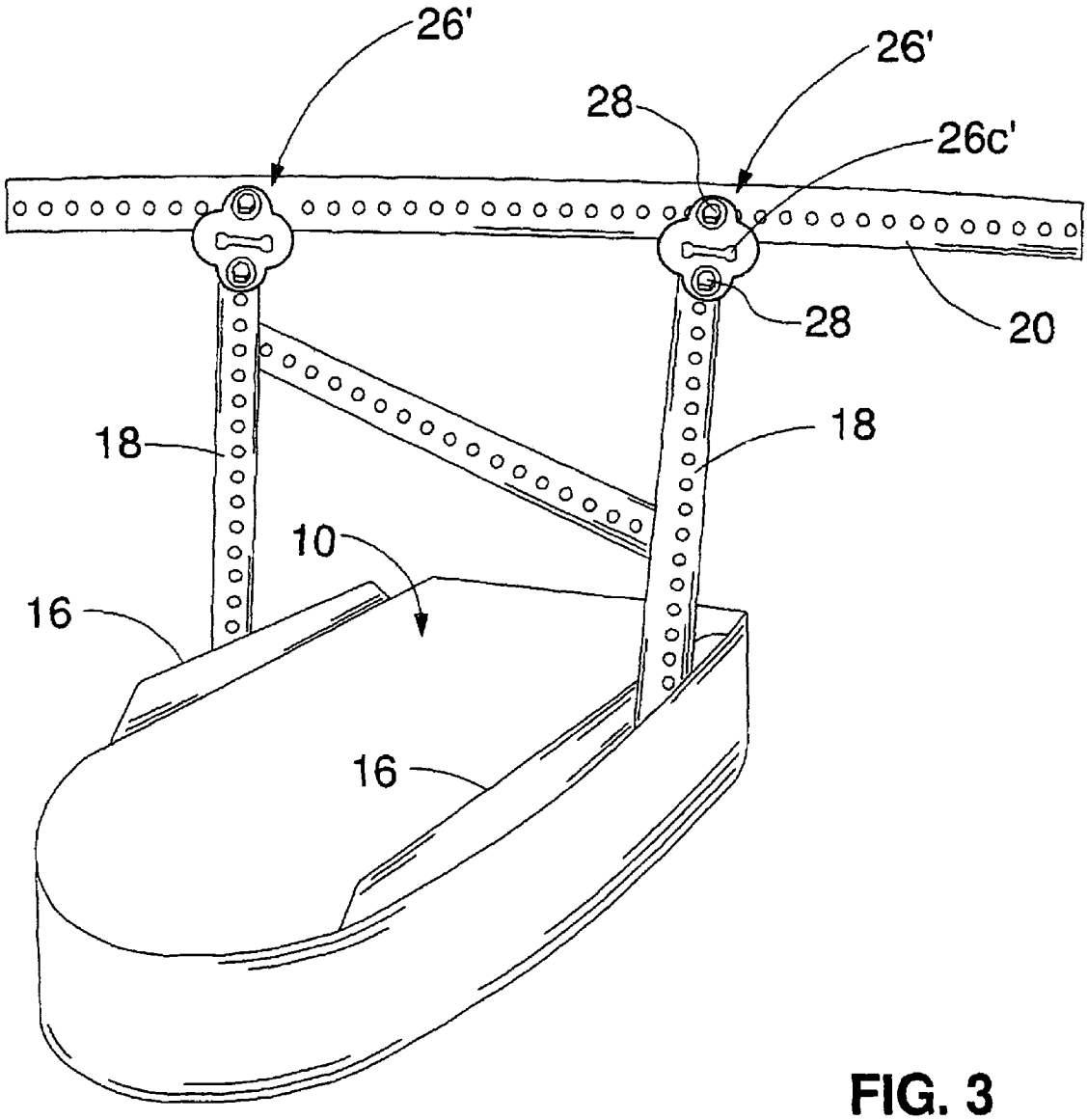
FIG. 3 is, in right side perspective view, a further embodiment of the noise dampener for a garage door opener according to the present invention.
Figure 3A:
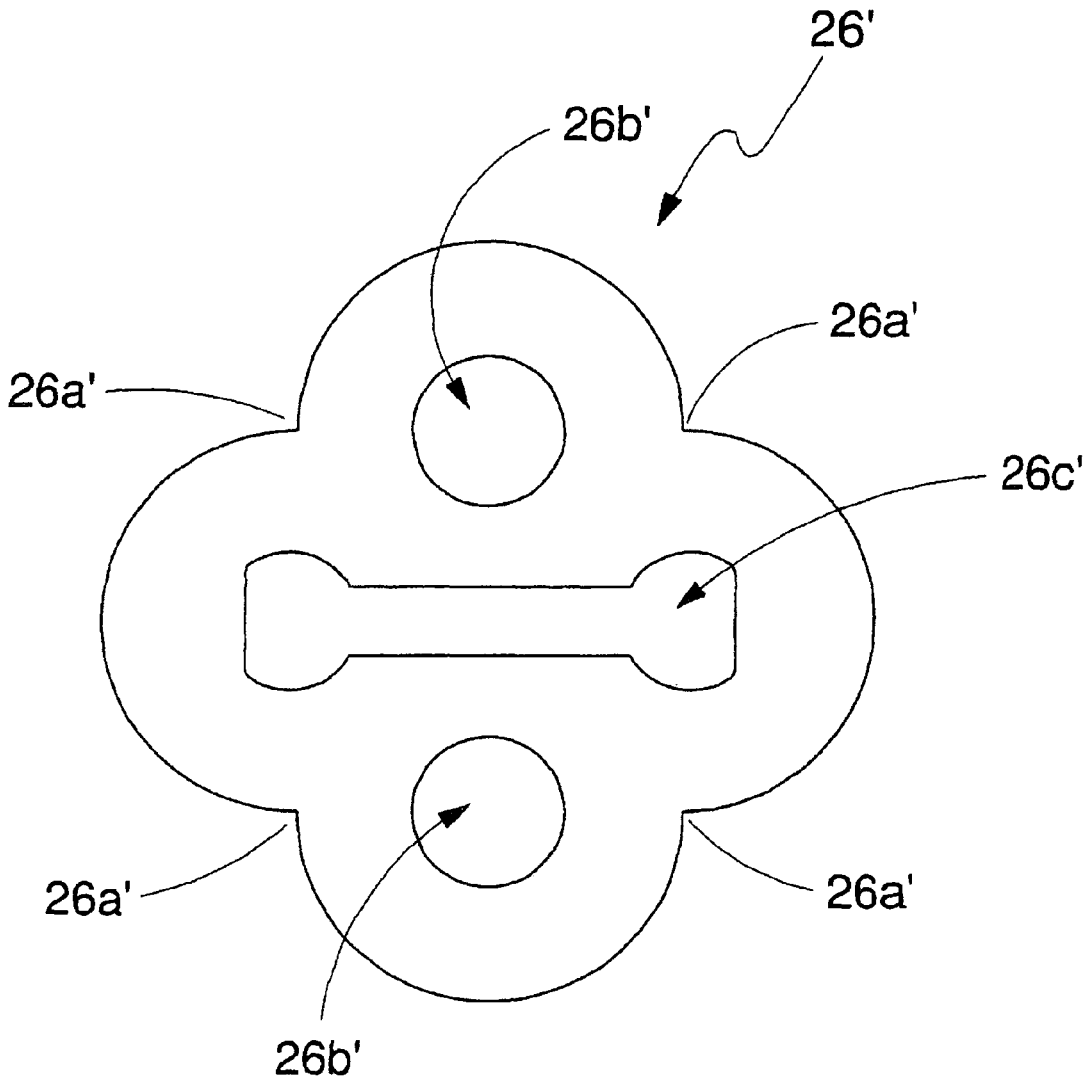
FIG. 3*a* is, in plan view, a resilient dampener according to the embodiment of FIG. 3.
Figure 4:
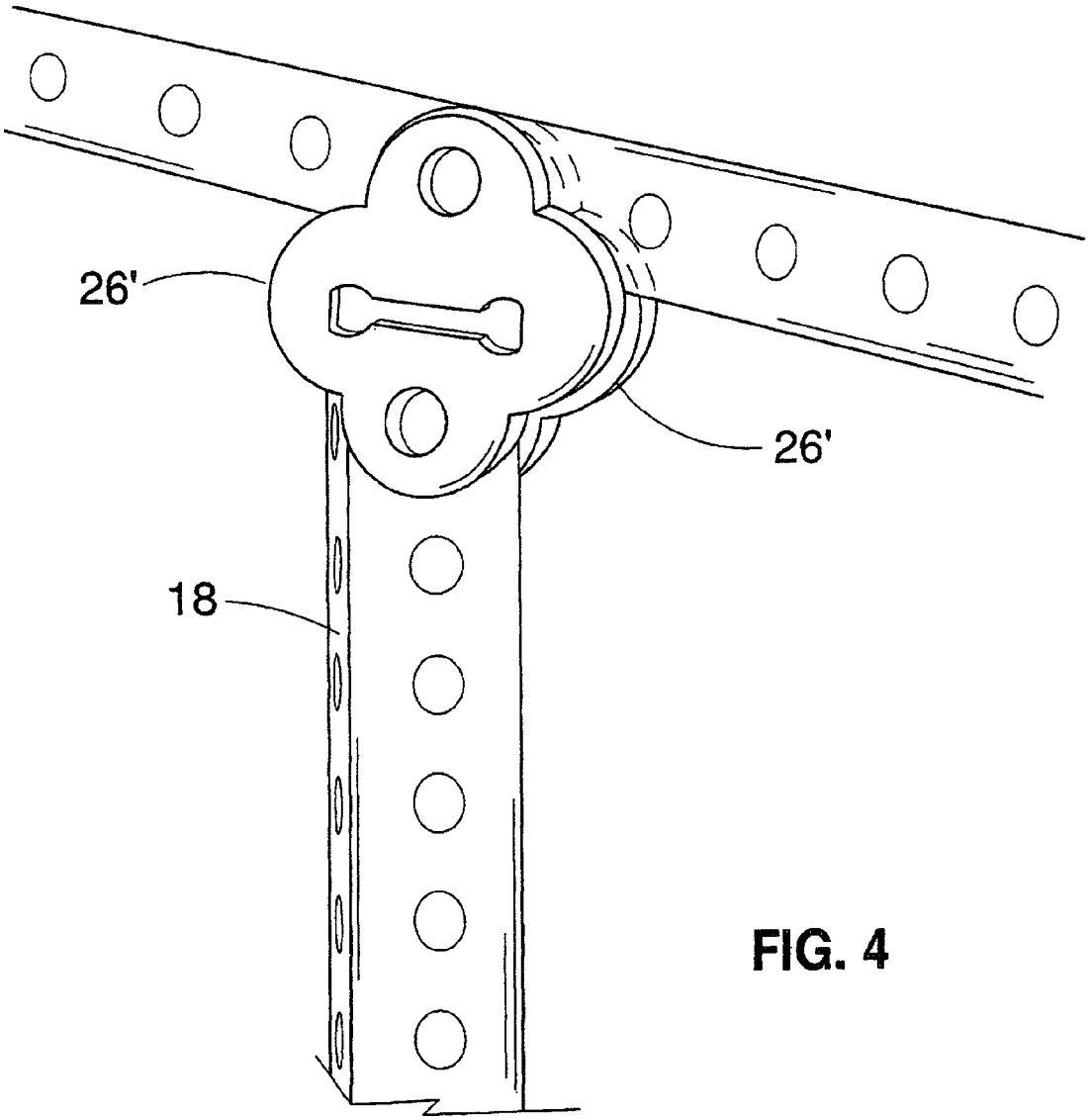
FIG. 4 is, in perspective view, a pair of the dampeners of FIG. 3*a* mounted to a strut and ceiling mounting bar.

In the present invention metal struts 18 are replaced in whole or in part with resilient hangers 26 as shown in FIG. 2. Without intending to be limiting, two embodiments of resilient hangers are depicted; namely, resilient hangers 26, and resilient hangers 26' as shown in FIGS. 3, 3*a* and 4.

Any suitable means may be used to attach the resilient hangers 26 or 26' so as to be suspended between motor mounting rails 16 and ceiling mounting bar 20. Without intending to be limiting, FIG. 2 illustrates an embodiment wherein two resilient mounting hangers 26 are bolted to corresponding motor mounting rails 16 and to the ceiling mounting bar 20. At the lower ends of each hanger 26, bolts 28 are inserted through holes in the corresponding hanger 26 and then through corresponding holes in motor mounting rail 16. Nuts secure the bolts in place. The upper ends of hangers 26 are bolted to ceiling mounting bar 20. Advantageously, bar 20 is mounted perpendicular to the long axis of channel 12 so that bar 20 crosses perpendicularly under the garage trusses (not shown) for a mounting of bar 20 thereto. Consequently, bar 20 is also perpendicular to rails 16. Each hanger 26 allows for a 90 degree twist between its upper and lower ends so that wide flange 26*a* of the upper end of the hanger may be mounted securely along bar 20, and wide flange 26*b* at the lower end of the hanger may be mounted securely along a corresponding rail 16. Because hangers 26 are resilient they allow for twisting torsion without compromising weight-bearing, that is, tensile strength.

In the embodiment of FIG. 2, two resilient hangers 26 are mounted on either side of motor housing 10. The use of two or more hangers 26 reduces the tensile load on each hanger and may improve attenuation of the vibration resulting from the operation of the motor and chain drive moving the garage door. In addition, the aperture, in this embodiment an elongate aperture 26*c*, along the centerline of each hanger is thought to further spread out, and thereby reduce on individual loading points, the static and dynamic loading on each hanger while at the same time further increasing the attenuation of vibration which causes noise.

As the static and dynamic loading on the resilient mounting hangers will cause stress concentration at, and strain of, the holes where hangers 26 are attached to rails 16 and will cause stress and strain of hangers 26 themselves, the resilient material selected for the hangers should be made of a resilient material which is tear resistant such as, without intending to be limiting, heavy rubber.

In another embodiment, in order to retrofit the resilient mounting hangers to garage door openers presently in use, three or four mounting hangers around the periphery of the motor housing, each hanger made of resilient material, may be utilized. This may result in increased stability, reduced static and dynamic weight-bearing load on each hanger and may increase attenuation of vibration.

In another embodiment of the present invention as seen in FIGS. 3, 3*a* and 4, resilient hangers 26' are mounted between the upper ends of struts 18 and bar 20. Without intending to be limiting, FIG. 3 illustrates two resilient hangers 26' bolted between metal struts 18 and ceiling mounting bar 20. Each resilient hanger 26' may be cloverleaf in shape so as to define four arcuate protrusions extending from between four corresponding notches or indentations 26*a*'. The upper and lower arcuate protrusions contain mounting holes 26*b*' for journaling of bolts 28 therethrough. Each hanger 26' has an elongate aperture 26*c*' along an axis approximately perpendicular to the vertical load, that is horizontal when installed. The indentations 26*a*' are contoured into an approximately 90 degree corner angle to fit over, that is conform to, the upper end of the L-shape of each strut 18 as seen in FIG. 4 such that each hanger 26' may be attached to a corresponding strut. Any suitable means may be used to mount resilient hangers 26' to struts 18 at one end, and to mounting bar 20 at the other end Conventionally, bar 20 is mounted perpendicular to the long axis of channel 12 so that bar 20 crosses under the garage trusses (not shown) for a mounting of bar 20 thereto. Consequently, bar 20 is also perpendicular to rails 16. As best seen in FIG. 4, utilization of two hangers 26' on each side of each strut 18 and on each side of mounting bar 20 reduces the weight-bearing tensile load on each hanger 26' thereby reducing the risk that bolts 28 will pull through the holes or otherwise tear the hangers 26'. The elongate aperture 26*c*' along the centerline of each hanger 26' is thought to further spread the static and dynamic loading on each hanger while at the same time, through the absorption by each hanger of the shock and vibration caused by the operation of the garage door opener, further increasing the attenuation of vibration which causes noise. Each hanger 26 or 26' serves as a vibration attenuating buffer between struts 18 and bar 20.

In another embodiment, in order to retrofit the resilient mounting hangers to garage door openers presently in use, three or four mounting hangers, each made of resilient materials, may be utilized. This may result in increased stability, reduced static and dynamic weight-bearing load on each hanger and increased attenuation of vibration.

In a further aspect of the invention, a resilient dampener 30 is mounted between the end of channel 12 opposite the motor and the garage wall 32 over the garage door opening.

Figure 5:
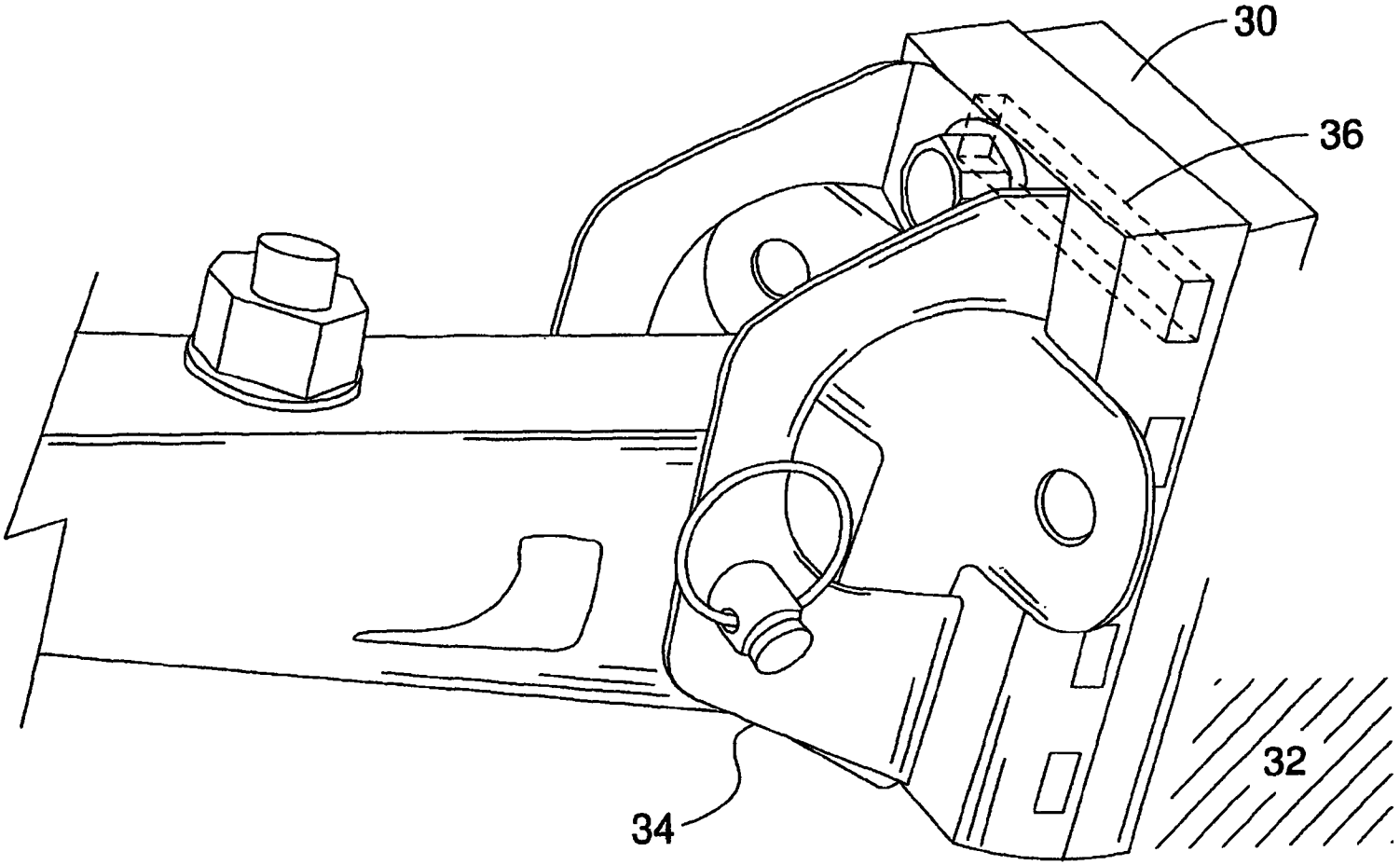
FIG. 5 is, in perspective view, one embodiment of a dampener mounted between the distal end of a chain supporting channel and a garage wall above a garage door.
Figure 6:
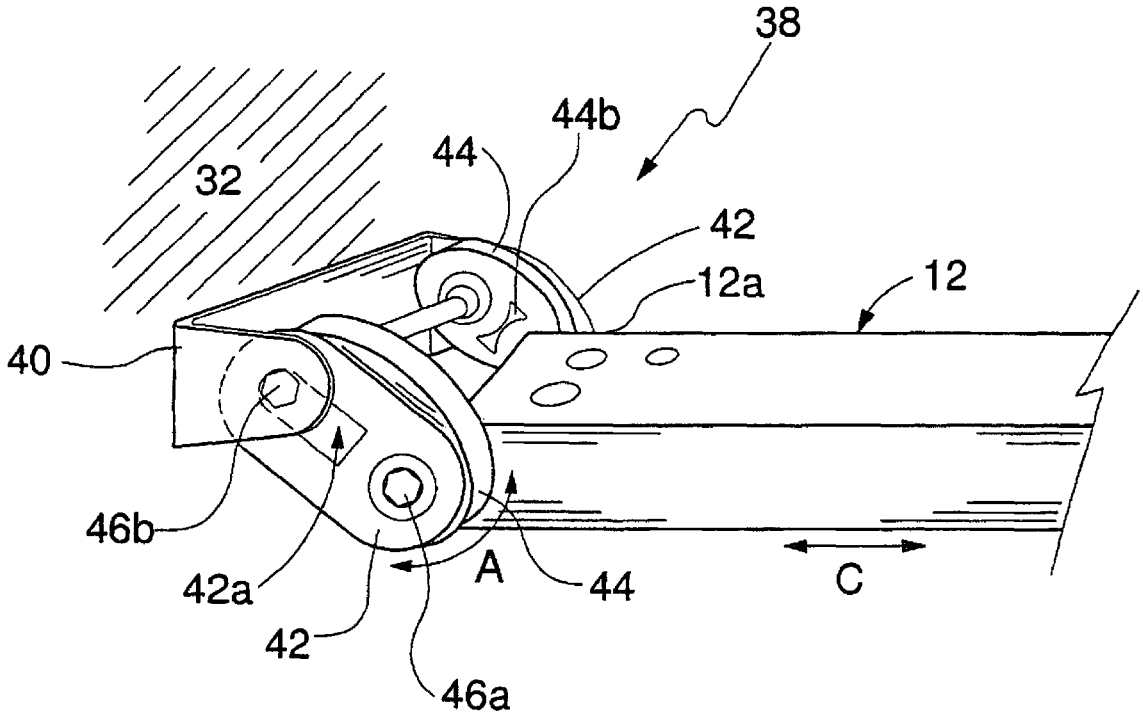
FIG. 6 is, in perspective view, a further embodiment of the dampener mounted between the distal end of the chain supporting channel and the garage wall above the garage door.
Figure 7:
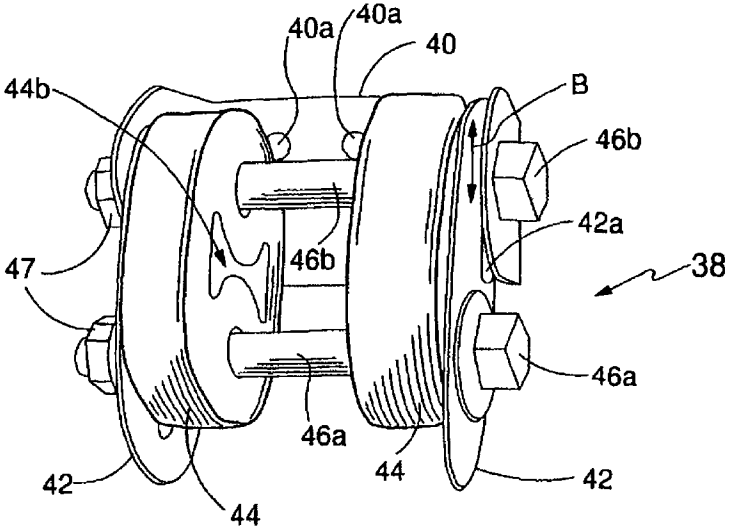
FIG. 7 is, in perspective view, the dampener of FIG. 6.
Figure 9:
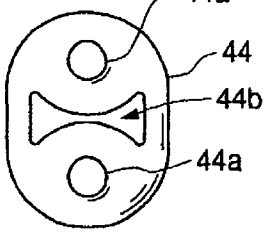
FIG. 9 is, in plan view, one of the compression absorbers of the dampener of FIG. 7.
Figure 8:
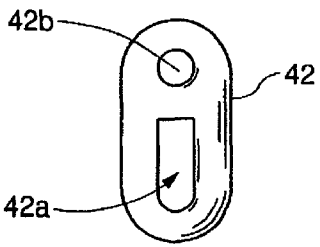
FIG. 8 is, in plan view, one of the rigid guides of the dampener of FIG. 7.

Without intending to be limiting, FIGS. 5 and 6 illustrate two embodiments of a resilient dampener mounted between the end of channel 12 and the garage door wall 32. Any suitable means may be used to attach the resilient dampener 30 between a mounting bracket 34 and the garage door wall 32. The dampener is made of a resilient material. Cavities, such as elongate passageways or ducts 36 in dampener 30 (ducts 36 shown partly in dotted outline in FIG. 5) extend in parallel array through dampener 30. Screws or the like are inserted through holes in mounting bracket 34 and through corresponding holes (not shown) in dampener 30 so as to mount into garage door wall 32. Passageways or ducts 36 serve as further shock absorbers, that is, they assist in absorbing or attenuating vibration transmitted from channel 12 into dampener 30.

In a further embodiment of the invention seen in FIGS. 6 to 9, mounting bracket 34 and dampener 30 are replaced with a shock absorber assembly 38. The end 12*a* of channel 12 is attached to garage door wall 32 by means of shock absorber assembly 38. Assembly 38 includes a U-shaped mounting bracket 40, two rigid extension limiter guides 42, two resilient compression absorbers 44, and bolts 46*a* and 46*b* for mounting the two extension limiter guides 42 and the two compression absorbers 44 between the U-shaped bracket 40 and end 12*a* of channel 12. Compression absorbers 44 are oblong in shape with mounting holes 44*a* located at each longitudinal end. An elongate, hour-glass shaped cavity 44*b* is formed so as to extend through each absorber 44 and perpendicular to the longitudinal axis bisecting the mounting holes 44*a*. The extension limiter guides 42 have an elongate aperture 42*a* in one end and a mounting hole 42*b* at the other end.

In use, the mounting bracket 40 is bolted to the wall 32 through holes 40*a*. The extension limiter guides 42 and compression absorbers 44 are attached to the U-shaped mounting bracket with bolts 46*a* and 46*b* journalled through holes 42*a*, 42*b* in guides 42 and holes 44*a* in absorbers 44. Nuts 46*a* secure bolts 46*a* and 46*b* in place.

When the garage door is in the closed position, the compression absorbers 44 and extension limiter guides 42 are closely parallel and proximate at one end to garage door wall 32. When the garage door opener is engaged, thereby causing the door to be raised, the compression absorbers 44 and the extension limiter guides 42 rotate in direction A on the axis of rotation about the two bolts 46*a* and 46*b*. The elongated apertures 42*a* of the extension limiter guides 42 allow bolt 46 mounted therein to slide forward and backwards in direction B with the movement in direction C of channel 12 caused by the operation of the garage door opener, taking with it the compression absorbers 44, being resilient, allow channel 12 to move toward and away from garage door wall 32. The forward and backward movement of channel 12 caused by the operation of the garage door opener creates pressure on bolt 46*a*, the pressure is transmitted to bolt 46*b* through absorber 44. As bolt 46*b* has limited mobility being constrained within hole 42*a*, and thus acts as a stop for the compression of absorbers 44 as channel 12 moves towards the wall 32. The compression absorbers 44 compress to absorb some or all of the forward movement of channel 12 toward the wall 32 and stretch to allow the backward movement of channel 12 away from wall 32. The movement of the channel is thereby cushioned or absorbed by the compression absorbers 44 to attenuate the vibration which, it is thought, causes noise.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A noise dampener system comprising:

a garage ceiling mounting bracket;

a garage door opener having a motor housing and a motor mount; and a pair of vibration attenuating resilient members, each vibration attenuating resilient member of said pair of vibration attenuating resilient members having first and second opposite ends and being indented in opposite lateral edges to define opposite lateral protrusions, said pair of vibration attenuating resilient members being mounted adjacent to one another with said first ends mounted to opposite sides of the garage ceiling mounting bracket and said second ends mounted to opposite sides of the motor mount mounted to an upper side of the motor housing of the garage door opener, in which the opposite lateral protrusions at least partially bear against said garage ceiling mounting bracket, wherein said first and second ends are mounted to the ceiling mounting bracket and the motor mount respectively by fastening means through apertures in said first and second ends.

2. The noise dampener system of claim 1 wherein the opposite lateral protrusions of each resilient member are located at a middle section between said first and second ends, and wherein said middle section is wider than said first and second ends, and wherein an elongate slot is formed in said middle section substantially perpendicularly to a loading direction extending between said first and second ends.

3. The noise dampener system of claim 2 wherein first indentations are formed in opposite lateral edges between said first end and said middle section.

4. The noise dampener system of claim 3 wherein second indentations are formed in opposite lateral edges between said second end and said middle section.

5. The noise dampener system of claim 4 wherein circumferential edges around said first end, said middle section, and said second end form a substantially four-leaf clover-leaf shape.

6. The noise dampener system of claim 5 wherein said elongate slot has bulbously enlarged end apertures at opposite ends of said elongate slot.

7. The noise dampener system of claim 6 wherein said first and second indentations form substantially 90 degree corners.

8. The noise dampener system of claim 1 in which the second ends are contoured to conform to opposite sides of a mounting end of a motor mount strut.

9. A noise dampened garage door opener comprising:

a motor housing having a motor mount mounted to an upper side thereof;

a garage ceiling mounting bracket mounted to the garage ceiling;

a pair of vibration attenuating resilient members, each vibration attenuating resilient member of said pair of vibration attenuating resilient members having first and second opposite ends and being indented in opposite lateral edges to define opposite lateral protrusions, said pair of resilient members mounted adjacent to one another with said first ends mounted to opposite sides of said garage ceiling mounting bracket and said second ends mounted to opposite sides of said motor mount, in which the opposite lateral protrusions at least partially bear against said garage ceiling mounting bracket, wherein said first and second ends are mounted to said ceiling mounting bracket and said motor mount respectively by fasteners through apertures in said first and second ends, in which the motor housing is at least not directly connected to the garage ceiling mounting bracket by struts; and a vibration dampening pad mounted between a garage wall adjacent to a garage door and a chain channel support extending from said motor housing.

10. The noise dampened garage door opener of claim 9 wherein the opposite lateral protrusions of each vibration attenuating resilient member are located at a middle section between said first and second ends, and wherein said middle section is wider than said first and second ends, and wherein an elongate slot is formed in said middle section substantially perpendicularly to a loading direction extending between said first and second ends.

11. The noise dampened garage door opener of claim 10 wherein first indentations are formed in opposite lateral edges between said first end and said middle section.

12. The noise dampened garage door opener of claim 11 wherein second indentations are formed in opposite lateral edges between said second end and said middle section.

13. The noise dampened garage door opener of claim 12 wherein circumferential edges around said first end, said middle section, and said second end form a substantially four-leaf clover-leaf shape.

14. The noise dampened garage door opener of claim 13 wherein said elongate slot has bulbously enlarged end apertures at opposite ends of said elongate slot.

15. The noise dampened garage door opener of claim 14 wherein said first and second indentations form substantially 90 degree corners.

16. The noise dampened garage door opener of claim 9 in which the motor mount comprises a strut with a mounting end and the second ends are mounted to opposite sides of the mounting end, the second ends being contoured to conform to the mounting end of the strut.

17. The noise dampened garage door opener of claim 9 in which the pair of vibration attenuating resilient members is a first pair of vibration attenuating resilient members, the motor housing has a second motor mount, and further comprising a second pair of vibration attenuating resilient members mounted to the second motor mount and to the garage ceiling mounting bracket at a different position than the first pair of vibration attenuating resilient members.

* * * * *